US010371385B2

(12) United States Patent
Benz et al.

(10) Patent No.: US 10,371,385 B2
(45) Date of Patent: Aug. 6, 2019

(54) SEQUENTIAL BURNER FOR AN AXIAL GAS TURBINE

(71) Applicant: Ansaldo Energia Switzerland AG, Baden (CH)

(72) Inventors: Urs Benz, Gipf-Oberfrick (CH); Andrea Ciani, Zürich (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 158 days.

(21) Appl. No.: 14/955,560

(22) Filed: Dec. 1, 2015

(65) Prior Publication Data

US 2016/0161125 A1 Jun. 9, 2016

(30) Foreign Application Priority Data

Dec. 4, 2014 (EP) ..... 14196291

(51) Int. Cl.
*F23R 3/20* (2006.01)
*F23R 3/28* (2006.01)
(Continued)

(52) U.S. Cl.
CPC ..... *F23R 3/286* (2013.01); *F23R 3/20* (2013.01); *F23R 3/283* (2013.01); *F23R 3/346* (2013.01);
(Continued)

(58) Field of Classification Search
CPC .. F23R 2900/03341; F23R 3/34; F23R 3/346; F23R 3/60; F23R 3/16;
(Continued)

(56) References Cited

U.S. PATENT DOCUMENTS 5,431,018 A 7/1995 Keller
5,626,017 A 5/1997 Sattelmayer
(Continued)

FOREIGN PATENT DOCUMENTS

CN 103542426 A 1/2014
CN 103672891 A 3/2014
(Continued)

OTHER PUBLICATIONS

European Search Report dated May 22, 2015, by the European Patent Office for Application No. 14196291.0.
(Continued)

*Primary Examiner* — Steven M Sutherland
*Assistant Examiner* — Thuyhang N Nguyen
(74) *Attorney, Agent, or Firm* — Buchanan Ingersoll & Rooney PC

(57) ABSTRACT

A sequential burner for an axial gas turbine comprises: a burner body, which is designed as an axially extending hot gas channel and further comprises a fuel injection device, which extends into said burner body perpendicular to the axial direction. The manufacturing of the burner body is simplified and the fuel injection is stabilized by designing said fuel injection device as a mechanically stiff component, and fixing said fuel injection device to said burner body in order to keep it aligned with said burner body and to stiffen said burner body against creep.

9 Claims, 6 Drawing Sheets

(51) Int. Cl.
*F23R 3/34* (2006.01)
*F23R 3/60* (2006.01)

(52) U.S. Cl.
CPC ..... *F23R 3/60* (2013.01); *F23R 2900/00018* (2013.01); *F23R 2900/03341* (2013.01)

(58) Field of Classification Search
CPC ..... F23R 2900/00017; F23R 60/735; F23R 2900/00018; F02K 3/10; F02K 60/761; F02K 60/765
See application file for complete search history.

(56) References Cited

U.S. PATENT DOCUMENTS

| | | | | |
|---|---|---|---|---|
| 6,536,216 | B2 * | 3/2003 | Halila | F01D 5/08 60/737 |
| 7,937,950 | B2 * | 5/2011 | Benz | F23R 3/283 431/154 |
| 8,950,187 | B2 | 2/2015 | Pasqualotto et al. | |
| 9,097,184 | B2 * | 8/2015 | Stryapunin | F02C 7/22 |
| 9,303,872 | B2 * | 4/2016 | Hadley | F23R 3/20 |
| 9,400,105 | B2 | 7/2016 | Genin et al. | |
| 9,506,374 | B2 * | 11/2016 | Batt | F01D 11/003 |
| 9,719,685 | B2 | 8/2017 | Durbin et al. | |
| 9,822,981 | B2 | 11/2017 | Ciani et al. | |
| 2002/0187448 | A1 | 12/2002 | Eroglu et al. | |
| 2007/0227157 | A1 | 10/2007 | Benz et al. | |
| 2011/0314825 | A1 | 12/2011 | Stryapunin et al. | |
| 2012/0272659 | A1 | 11/2012 | Syed et al. | |
| 2012/0297787 | A1 * | 11/2012 | Poyyapakkam | B01F 5/0451 60/772 |
| 2012/0324863 | A1 | 12/2012 | Winkler et al. | |
| 2013/0031908 | A1 * | 2/2013 | DiCintio | F23R 3/06 60/752 |
| 2013/0152597 | A1 | 6/2013 | Durbin et al. | |
| 2013/0174558 | A1 * | 7/2013 | Stryapunin | F23R 3/286 60/734 |
| 2014/0013760 | A1 | 1/2014 | Pasqualotto et al. | |
| 2014/0065562 | A1 | 3/2014 | Genin et al. | |
| 2015/0013339 | A1 | 1/2015 | Ciani et al. | |

FOREIGN PATENT DOCUMENTS

| | | | |
|---|---|---|---|
| CN | 104114951 | A | 10/2014 |
| CN | 104185762 | A | 12/2014 |
| EP | 2 522 912 | A1 | 11/2012 |
| EP | 2570728 | A1 | 3/2013 |
| EP | 2 725 301 | A1 | 4/2014 |

OTHER PUBLICATIONS

First Office Action dated Dec. 3, 2018, by the Chinese Patent Office in corresponding Chinese Patent Application No. 201510876431.9, and an English Translation of the Office Action. (17 pages).

* cited by examiner

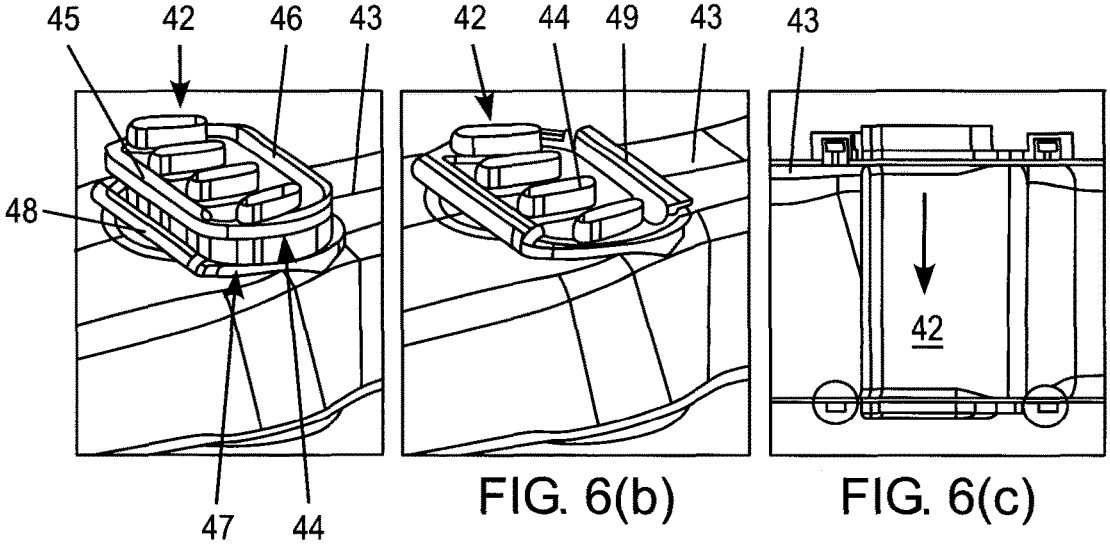
FIG. 6(a)
FIG. 6(b)
FIG. 6(c)
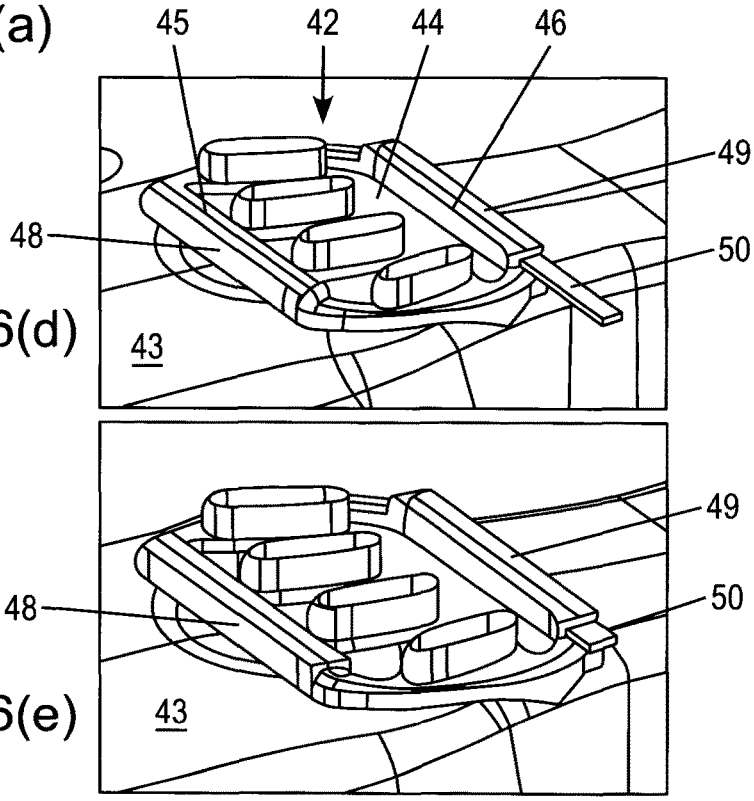
FIG. 6(d)
FIG. 6(e)

SEQUENTIAL BURNER FOR AN AXIAL GAS TURBINE

BACKGROUND OF THE INVENTION

The present invention relates to the technology of gas turbines. It refers to a sequential burner for an axial gas turbine according to the preamble of claim 1.

PRIOR ART

In order to achieve a high efficiency, a high turbine inlet temperature is required in standard gas turbines. As a result, there arise high NOx emission levels and high life cycle costs. These problems can be mitigated with a sequential combustion cycle (e.g. using a burner of the type as disclosed in U.S. Pat. Nos. 5,431,018 or 5,626,017 or in U.S. 2002/0187448, also called SEV combustor, where the S stands for sequential). Both combustors contain premixing burners, as low NOx emissions require high mixing quality of the fuel and the oxidizer.

An exemplary gas turbine of the applicant with sequential combustion, which is known as GT26, is shown in FIG. 1.

Gas turbine 10 of FIG. 1 comprises a rotor 11 with a plurality of blades rotating about a machine axis 20 and being surrounded by a casing 12. Air is taken in at air inlet 13 and is compressed by compressor 14. The compressed air is used to burn a first fuel in a first (annular) combustor 15, thereby generating hot gas. The hot gas drives a first, high pressure (HP) turbine 16, is then reheated in a second (annular, sequential) combustor 17, drives a second, low pressure (LP) turbine 18 and exits gas turbine 10 through exhaust gas outlet 19. While in the case of the gas turbine shown in FIG. 1 said sequential combustor is arranged between a first and second turbine, the present invention is not restricted to this case but relates to sequential combustors and burners in general.

FIG. 2 shows (in FIG. 2(*b*)) a prior art secondary combustor of a gas turbine of the kind depicted in FIG. 1, where an SEV fuel lance slides into the burner, but is not fixed to it. In this current configuration, the SEV lance is fixed at a flange to an outer casing. Therefore, the injection location moves radially relatively to the burner due to thermal expansions.

Document EP 2 522 912 A1 relates to a combined flow straightener and mixer as well as a burner for a combustion chamber of a gas turbine comprising such a mixing device. For a combined function of flow straightening and mixing at least two streamlined bodies are arranged in a structure comprising the side walls of the mixer. The leading edge area of each streamlined body has a profile, which is oriented parallel to a main flow direction prevailing at the leading edge position, and wherein, with reference to a central plane of the streamlined bodies the trailing edges are provided with at least two lobes in opposite transverse directions. The periodic deflections forming the lobes from two adjacent streamlined bodies are out of phase. The disclosure further relates to a burner for a combustion chamber of a gas turbine, comprising such a flow straightener and mixer as well as at least one nozzle having its outlet orifice at or in a trailing edge of the streamlined body. Further, it relates to the operation of such a burner.

Document EP 2 725 301 A1 relates to a burner for a combustion chamber of a gas turbine with a mixing and injection device, wherein the mixing and injection device is comprising a limiting wall that defines a gas-flow channel and at least two streamlined bodies, each extending in a first transverse direction into the gas-flow channel. Each streamlined body has two lateral surfaces that are arranged essentially parallel to the main-flow direction, the lateral surfaces being joined to one another at their upstream side to form a leading edge of the body and joined at their downstream side to form a trailing edge of the body. Each streamlined body has a cross-section perpendicular to the first transverse direction that is shaped as a streamlined profile. At least one of said streamlined bodies is provided with a mixing structure and with at least one fuel nozzle located at its trailing edge for introducing at least one fuel essentially parallel to the main-flow direction into the flow channel, wherein at least two of the streamlined bodies have different lengths along the first transverse direction such that they may be used for a can combustor.

In this case, the nozzles used for fuel injection are in a radial alignment. The difference to the fuel lance of FIG. 2 becomes apparent in FIG. 3: FIG. 3(*a*) relates to the case of a fuel lance 21, which is inserted into but not fixed to the burner body 27, which guides a hot gas flow 29. The central injector 25 at the end of fuel lance 21 injects fuel through nozzles 26 perpendicular to hot gas flow 29. The distance between nozzles 26 and the upper and lower walls is quite large and thus relatively insensitive to the radial location of fuel lance 21.

On the other hand, when an injection head 30 is used with a radial inline series of injection points (FIG. 3(*b*)), the distance between the injector nozzles and the upper/lower walls of burner body 31 is much lower and therefore more sensitive to the radial location of the lance.

In existing secondary burners high creep resistant materials are used and the size of the burner is small in comparison with the new requirements. For these new requirements solutions could be found with more expensive materials or larger wall thickness that would increase the cost, worsen the LCF properties and possibly impose casting as manufacturing option.

The SEV burner is subject to a large pressure drop between its cold and hot side. It is also exposed to high temperatures. Also due to its mainly rectangular shape, the upper and lower walls can creep and its shape and robustness is compromised. The multipoint injection system shown in FIG. 3(*b*) is more sensitive to radial displacement of the lance relative to the burner body.

Although the problems have been discussed so far for a sequential burner with essentially rectangular cross-section, the problem and the solution to be found is not restricted to sequential burners with rectangular cross-section. In general, the cross-section can be for example rectangular, circular or trapezoidal.

SUMMARY OF THE INVENTION

It is an object of the present invention to provide a sequential burner, which avoids disadvantages of known sequential burners and allows a multipoint injection scheme without requiring new materials or designs for the burner body.

This and other objects are obtained by a sequential burner as claimed in claim 1.

According to the invention, a sequential burner for an axial gas turbine comprises a burner body, which is designed as an axially extending hot gas channel, and further comprises a fuel injection device, which extends into said burner body perpendicular to the axial direction.

Said sequential burner is characterized in that said fuel injection device is designed as a mechanically stiff component, and that said fuel injection device is fixed to said burner body in order to keep it aligned with said burner body and to stiffen said burner body against creep.

According to an embodiment of the inventive sequential burner said fuel injection device is an injection head comprising a plurality of fingers extending parallel to each other and perpendicular to the axial direction between an upper end plate and a lower end plate, and said injection head is fixed with its upper endplate to an outer wall of said burner body, whereby its lower end plate is flush with an inner wall of said burner body.

Specifically, a burner flange is provided in said outer wall of said burner body, said injection head sits in said burner body with its upper end plate flush with said burner flange, and said upper end plate is fixed to said burner flange by means of sliding inserts.

More specifically, said upper and lower end plates of said injection head and said burner flange are circular, and said upper end plate is fixed to said burner flange by means of multiple inserts, which are distributed along the circumference of said burner flange and said upper end plate, respectively.

Even more specifically, each of said inserts is fixed to said burner flange by means of a fixing lug, and each of said inserts has a foot, which meshes on one side with a circumferential groove at said burner flange and on the opposite side with a related of a plurality of hooks being distributed along the circumference of said upper end plate.

Specifically, there is a gap provided within said series of distributed hooks for introducing an insert and sliding it from said gap to its final position along a circumferential path.

Alternatively, said upper and lower end plates of said injection head and said burner flange are non-circular with two parallel longitudinal sides, and said upper end plate is fixed to said burner flange by means of two straight inserts or wedges inserted at said longitudinal sides.

Specifically, each of said inserts meshes on one side with a slotted outer rail at said longitudinal sides of said burner flange and on the opposite side with a slotted inner rail at said longitudinal sides of said upper end plate.

According to another embodiment of the invention each of said fingers is configured as a streamlined body which has a streamlined cross-sectional profile, whereby said body has two lateral surfaces essentially parallel to the flow direction of the hot gas passing through said burner body, whereby said lateral surfaces are joined at their upstream side by a leading edge and at their downstream side forming a trailing edge, and whereby a plurality of nozzles for injecting a gaseous and/or liquid fuel mixed with air is distributed along said trailing edge.

BRIEF DESCRIPTION OF THE DRAWINGS

The present invention is now to be explained more closely by means of different embodiments and with reference to the attached drawings.

FIGS. 6(*a*)-(*e*) show various steps of the assembly of a sequential burner with non-circular injection head according to another embodiment of the invention.

DETAILED DESCRIPTION OF DIFFERENT EMBODIMENTS OF THE INVENTION

A basic idea of the present invention is to use the fuel injection head of a sequential burner as stiffening element for a more robust SEV design. At the same time, fixing the sequential burner injection head at the burner body keeps it centered (aligned) with the burner body.

Figure 1:
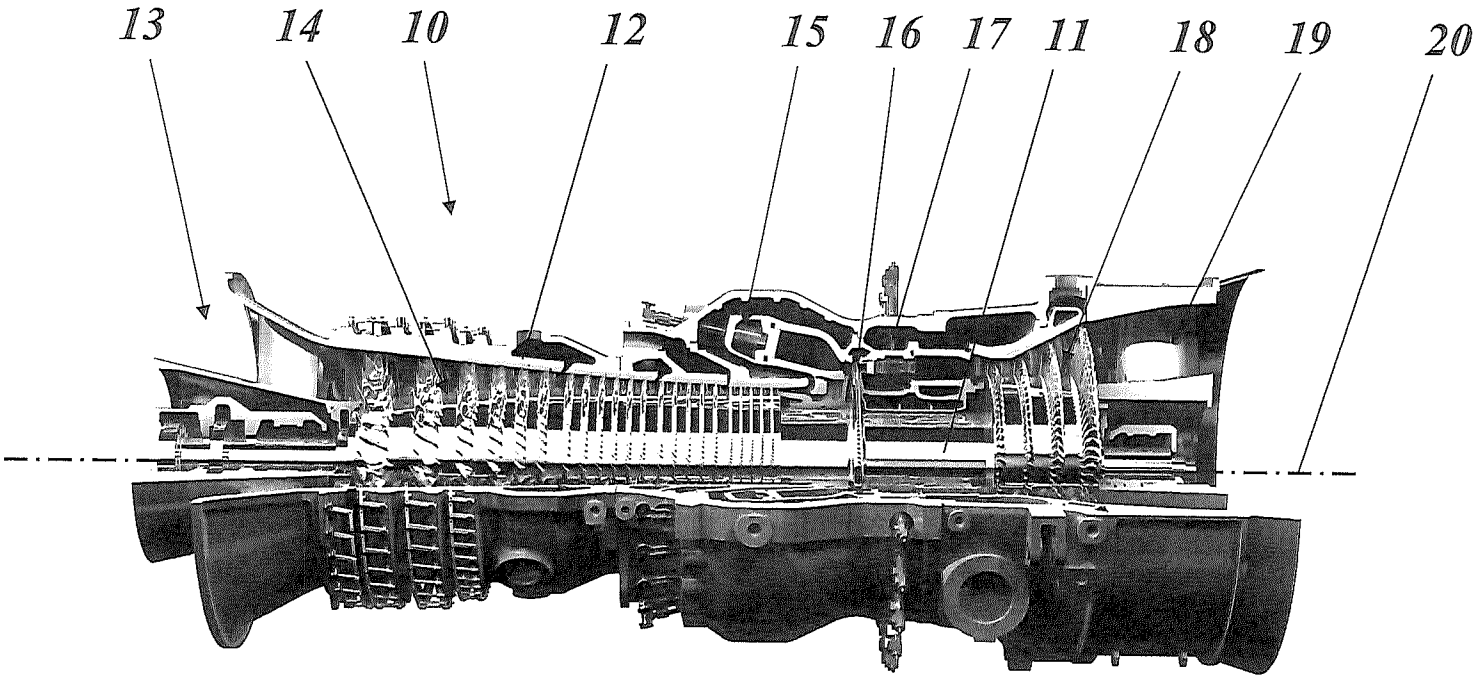
Prior Art FIG. 1
FIG. 1 shows an exemplary gas turbine with sequential combustion of the type GT26 of the applicant.
Figure 2A:
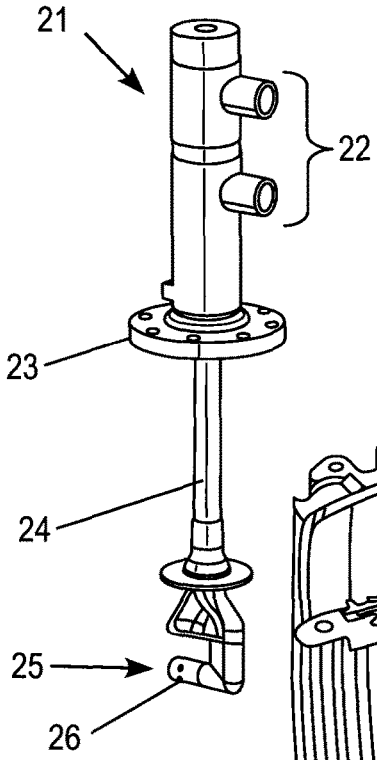
FIGS. 2(*a*)-(*b*) show (in FIG. 2(*b*)) a known secondary combustor of a gas turbine of the kind depicted in FIG. 1 with a fuel lance (FIG. 2(*a*) fixed on an outer casing.
Figure 2B:
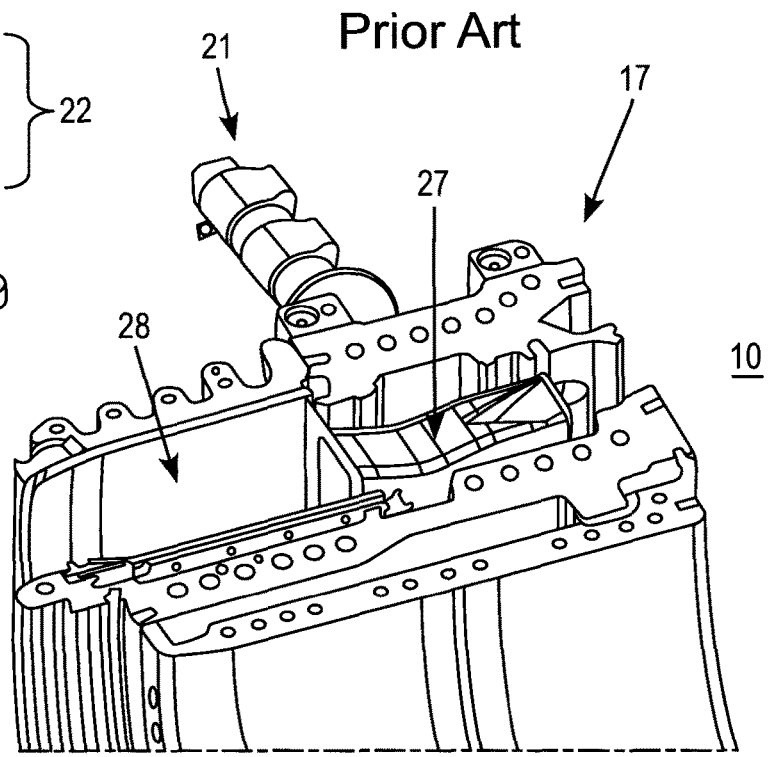
Figure 3A:
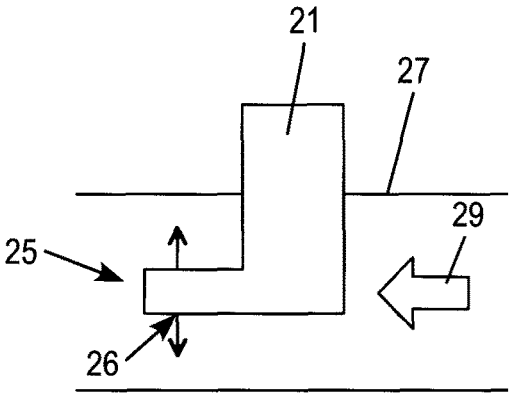
FIGS. 3(*a*)-(*b*) show in comparison the fuel injection situation for a known fuel lance (FIG. 3(*a*)) and a multipoint inline injection scheme (FIG. 3(*b*))
Figure 3B:
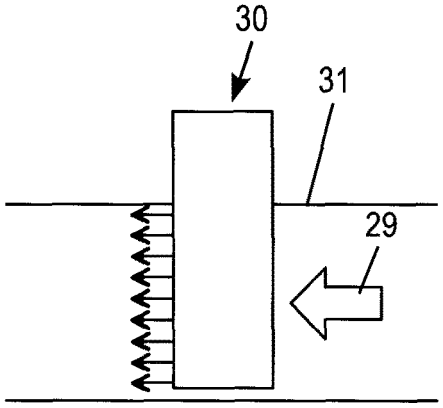

In the prior art (see FIG. 2) an injector lance is assembled into the SEV burner sliding into it from an SEV burner flange. The lance is fixed on the outer casing and it is kept free to radially move relatively to the burner body. For other engines, a different type of injector is used: the so called VG injection head. For this system (multipoint inline injection), the distance between the injector nozzles and the upper/lower walls in much lower and therefore more sensitive to the radial location of the lance (see FIG. 3(*b*)).

The idea now is to fix the injection head to the top of the burner and flush with the bottom of it.

Figure 4A:
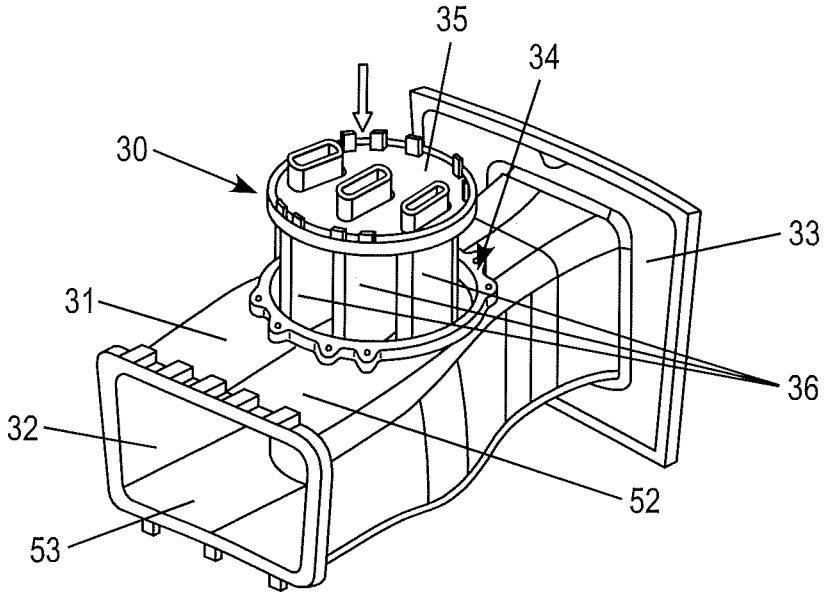
FIGS. 4(*a*)-(*b*) show the assembly of a sequential burner with circular injection head according to an embodiment of the invention with FIG. 4(*a*) related to the insertion process and FIG. 4(*b*) showing the final configuration.
Figure 4B:
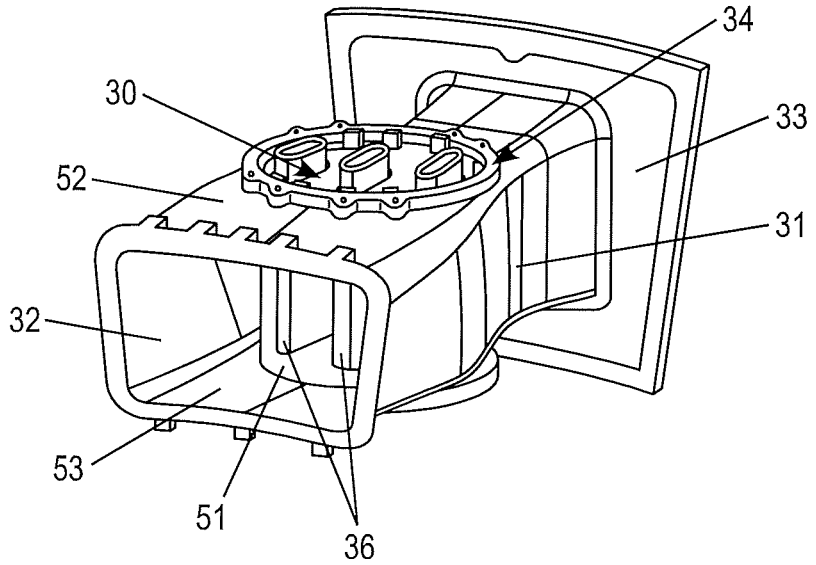
Figure 5A:
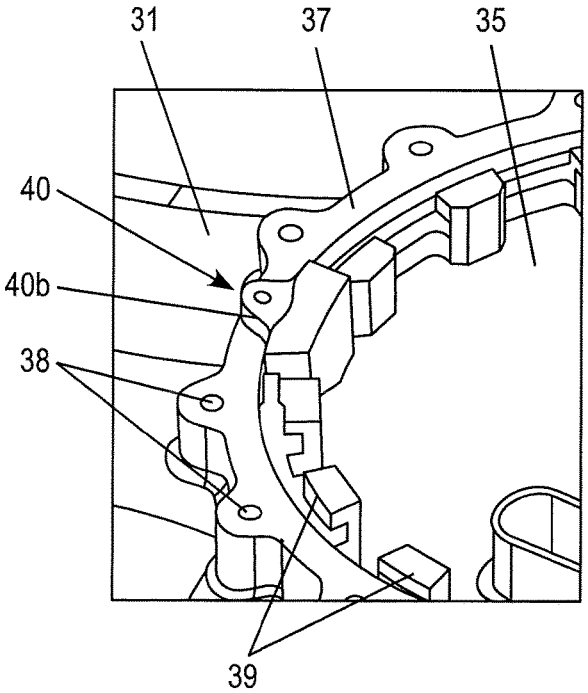
FIGS. 5 (*a*)-(*f*) show various steps of the process of introducing inserts for fixing the burner head to the burner body in an embodiment according to FIG. 4.
Figure 5B:
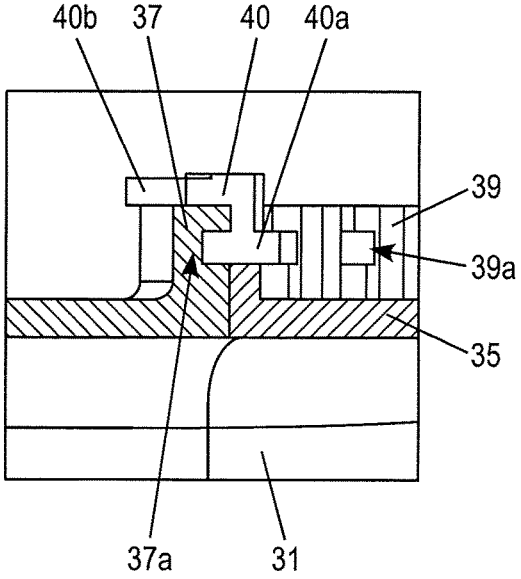
Figure 5C:
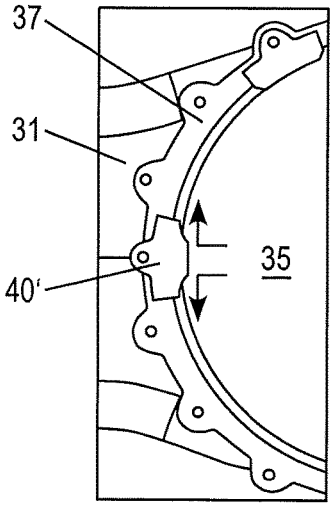
Figure 5D:
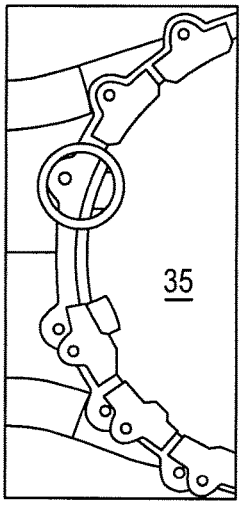
Figure 5E:
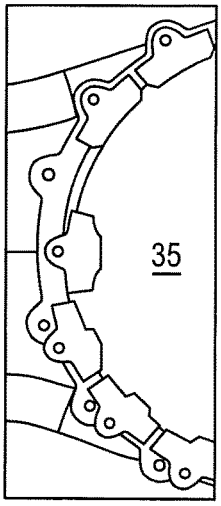
Figure 5F:
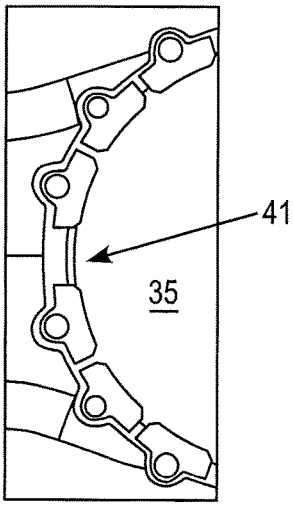

FIG. 4 shows an embodiment for the case of a burner body with circular burner flange, with the associated mounting procedure sketched in FIG. 5.

In FIG. 4, a burner body 31, which extends in axial direction between a burner inlet 32 and a burner outlet 33 and has in this example an essentially rectangular cross section with an outer (or upper) wall 52 and an inner (or lower) wall 53, has a circular opening 34 in the outer wall 52 surrounded by a burner flange (37 in FIG. 5). The opening 34 receives a circular injection head 30. Injection head 30 comprises in this example 3 parallel fingers, which extend perpendicular to the direction of hot gas flow 29 between a circular upper end plate 35 and a circular lower end plate 51.

Each of said fingers 36 is configured as a streamlined body which has a streamlined cross-sectional profile, whereby said body has two lateral surfaces essentially parallel to the flow direction of the hot gas passing through said burner body 31. Said lateral surfaces are joined at their upstream side by a leading edge and at their downstream side forming a trailing edge. A plurality of nozzles (not shown in the Figures) for injecting a gaseous and/or liquid fuel mixed with air is distributed along said trailing edge.

Injection head 30 is configured such that the upper end plate 35 is flush with the burner flange 37 and the lower end plate 51 is flush with the inner wall 53, when injection head 30, after sliding into burner body 31 (FIG. 4(*a*)) is in the end fully inserted into burner body 31 (FIG. 4(*b*)).

When injection head 30 has been fully inserted into burner body 31, it is fixed at burner flange 37 according to a procedure shown in FIG. 5: Ring-like burner flange 37 is provided with a circumferential groove 37*a* on its inner side. At its outer side multiple bulges are provided and distributed along the circumference, each comprising a tapped hole 38. Corresponding to these multiple bulges and tapped holes 38, upper end plate 35 of injection head 30 is provided with multiple hooks 39, which are distributed accordingly along the periphery of upper end plate 3 and have each a recess 39*a*, which is opposite to and corresponds with groove 37*a* of the burner flange 37.

Injection head 30 is fixed to the burner body and balcony with inserts 40, 40' as shown in FIG. 5(*b*). Inserts 40 correspond to hooks 39 and are distributed along the circumference of burner flange 37 and upper end plate 35, respectively. Each of said inserts 40, 40' is fixed to burner flange 37 with a threaded bolt by means of a fixing lug 40*b*. Each of said inserts 40, 40' has a (horizontal) foot 40*a*, which meshes on one side with circumferential groove 37*a* at said burner flange 37 and on the opposite side with a related hook 39 and its recess 39*a*. Inserts 40, 40' thus slide around burner flange 37 and fix injection head 30 to the burner body with bolts.

As shown in FIGS. 5(*c*) to 5(*f*), there is a gap 41 provided within said series of distributed hooks 39 for introducing an insert 40' and sliding it clockwise or counter-clockwise from said gap 41 to its final position along a circumferential path, where it is fixed with a threaded bolt.

If an injection head has more than three fingers, e.g. four fingers, a non-round solution is needed. In this case, the injection head can also slide into the burner body, but the shape has two long straight slits (or slotted rails) used to fix the burner with straight inserts or wedges.

FIG. 6 shows an embodiment with such a non-round balcony and the related fixation concept. Injection head 42 of FIG. 6 with its four fingers has upper end plate 44 and a lower end plate and can be inserted into burner body 43. Burner flange 47 of burner body 43 is non-circular with two parallel longitudinal sides, whereby upper end plate 44 is fixed to said burner flange 47 by means of two straight inserts or wedges 50 inserted at said longitudinal sides. Thereby, each of said inserts 50 meshes on one side with a respective slotted outer rail 48, 49 at said longitudinal sides of said burner flange 47 and on the opposite side with a respective slotted inner rail 45, 46 at said longitudinal sides of upper end plate 44 (see FIGS. 6(*d*) and 6(*e*)). At the same time, the lower end plate is flush with the inner wall of burner body 43, as explained for the circular injection head, before.

Figure 7:
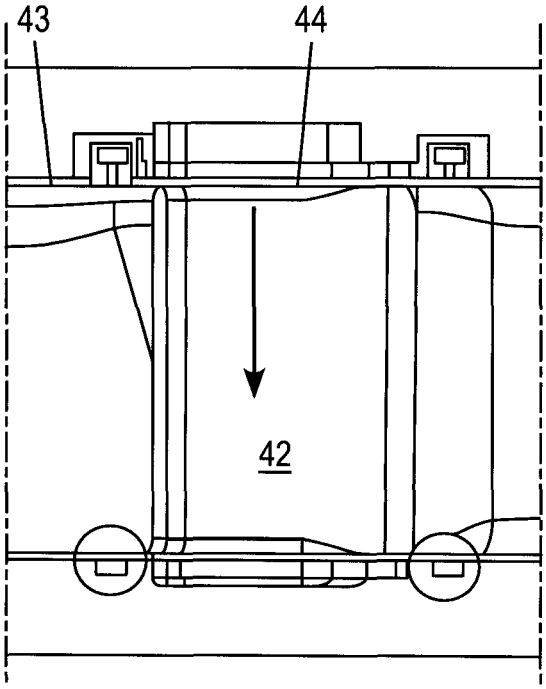
FIG. 7 is a side view of the assembled sequential burner according to FIG. 6.

The side view of FIG. 7 makes clear that said stiff injection head 42 stiffens the burner body 43 in that creep deformation is prevented, whereby the fingers act as stiffening elements against burner body creep.

To sum up, fixing the burner on top and preventing the bottom to deform inwards, the injection head not only serves its fuel injection purposes but also prevents the upper and lower walls to creep because of their high temperatures and the strong pressure difference between the cold and the hot side. At the same time the injection head is always centered and aligned with the burner body.

The advantages of the invention are:

It allows the use of cheaper material (e.g. HastX instead of Haynes 230);

It allows lower wall thickness and therefore lower cost, as the burner body can be fabricated by welded metal sheet;

It prevents flashback and high emission due to radial misalignment of the lance with the burner.

LIST OF REFERENCE NUMERALS

10 gas turbine (GT, e.g. GT26)
11 rotor
12 casing
13 air inlet
14 compressor
15 combustor (annular, e.g. EV)
16 high pressure (HT) turbine
17 combustor (annular, secondary, e.g. SEV)
18 low pressure (LP) turbine
19 exhaust gas outlet
20 machine axis
21 fuel lance
22 fuel port
23 flange
24 tube
25 injector
26 nozzle
27,31 burner body
28 combustion chamber
29 hot gas flow
30 injection head (3 fingers)
32 burner inlet
33 burner outlet
34 opening
35 upper end plate
36 finger
37 burner flange
37*a* groove (circumferential)
38 tapped hole
39 hook
39*a* recess
40,40' insert
40*a* foot
40*b* fixing lug
41 gap
42 injection head (4 fingers)
43 burner body
44 upper end plate
45,46 slotted inner rail
47 burner flange
48,49 slotted outer rail
50 wedge (straight insert)
51 lower end plate
52 outer wall (burner body)
53 inner wall (burner body)

The invention claimed is:

1. A sequential burner for an axial gas turbine, comprising:

a burner body, which is configured as an axially extending hot gas channel; and a fuel injection device extending into said burner body perpendicular to an axial direction, wherein said fuel injection device is fixed to said burner body to keep the fuel injection device aligned with said burner body and to stiffen said burner body against creep;

wherein said fuel injection device is an injection head including:

a plurality of fingers arranged in the axially extending hot gas channel and extending parallel to each other and perpendicular to the axial direction between an upper end plate and a lower end plate, and that said upper end plate is fixed to an outer wall of said burner body, whereby said lower end plate is flush with an interior of an inner wall of said burner body and that said injection head sits in said burner body with the upper end plate flush with an interior wall of the outer wall, wherein a burner flange is provided in said outer wall of said burner body, and said upper end plate is fixed to said burner flange by a plurality of inserts configured to slide circumferentially, wherein said upper and lower end plates of said injection head and said burner flange are circular, and said upper end plate is fixed to said burner flange by the plurality of the inserts distributed along a circumference of said burner flange and a circumference of said upper end plate, respectively, wherein each of said plurality of inserts is fixed to said burner flange by a fixing lug, and each of said plurality of inserts has a foot, which meshes on one side with a circumferential groove at said burner flange and on an opposite side with a plurality of hooks distributed along the circumference of said upper end plate.

2. The sequential burner as claimed in claim 1, wherein there is a gap provided within the plurality of hooks for introducing each of the plurality of inserts and sliding each of the plurality of inserts from said gap to a final position along a circumferential path.

3. The sequential burner as claimed in claim 1, wherein each of said plurality of fingers is configured as a streamlined body which has a streamlined cross-sectional profile, whereby said streamlined body has two lateral surfaces parallel to a flow direction of hot gas passing through said burner body, whereby said lateral surfaces are joined at their upstream side by a leading edge and at their downstream side forming a trailing edge, and whereby a plurality of nozzles for injecting a gaseous and/or liquid fuel mixed with air is distributed along said trailing edge.

4. A sequential burner for an axial gas turbine, comprising:

a burner body, which is configured as an axially extending hot gas channel within a combustion chamber of the axial gas turbine; and a fuel injection device extending into said burner body perpendicular to an axial direction, wherein said fuel injection device is fixed to said burner body to keep the fuel injection device aligned with said burner body and to stiffen said burner body against creep;

wherein said fuel injection device is an injection head including:

a plurality of fingers arranged in the axially extending hot gas channel and extending parallel to each other and perpendicular to the axial direction between an upper end plate and a lower end plate, and that said upper end plate is fixed to an outer wall of said burner body, whereby said lower end plate is flush with an interior of an inner wall of said burner body and that said injection head sits in said burner body with the upper end plate flush with an interior wall of the outer wall, wherein said upper and lower end plates of said injection head and said burner flange are non-circular with two parallel longitudinal sides, and said upper end plate is fixed to said burner flange by two straight inserts inserted between the two parallel longitudinal sides of the upper end plate.

5. The sequential burner as claimed in claim 4, wherein each of said two straight inserts meshes on one side with a slotted outer rail at said two parallel longitudinal sides of said burner flange and on an opposite side with a slotted inner rail at said two parallel longitudinal sides of said upper end plate.

6. The sequential burner as claimed in claim 4, wherein each of said plurality of fingers is configured as a streamlined body which has a streamlined cross-sectional profile, whereby said streamlined body has two lateral surfaces parallel to a flow direction of hot gas passing through said burner body, whereby said lateral surfaces are joined at their upstream side by a leading edge and at their downstream side forming a trailing edge, and whereby a plurality of nozzles for injecting a gaseous and/or liquid fuel mixed with air is distributed along said trailing edge.

7. A sequential burner for an axial gas turbine, comprising:

a burner body, which is configured as an axially extending hot gas channel within a combustion chamber of the axial gas turbine; and a fuel injection device extending into said burner body perpendicular to an axial direction, wherein said fuel injection device is fixed to said burner body to keep the fuel injection device aligned with said burner body and to stiffen said burner body against creep;

wherein said fuel injection device is an injection head including:

a plurality of fingers arranged in the axially extending hot gas channel and extending parallel to each other and perpendicular to the axial direction between an upper end plate and a lower end plate, and that said upper end plate is fixed to an outer wall of said burner body, whereby said lower end plate is flush with an interior of an inner wall of said burner body and that said injection head sits in said burner body with the upper end plate flush with an interior wall of the outer wall, wherein said upper and lower end plates of said injection head and said burner flange are non-circular with two parallel longitudinal sides, and that said upper end plate is fixed to said burner flange by two straight wedges inserted at said two parallel longitudinal sides.

8. The sequential burner as claimed in claim 7, wherein each of said two straight wedges meshes on one side with a slotted outer rail at said two parallel longitudinal sides of said burner flange and on the opposite side with a slotted inner rail at said two parallel longitudinal sides of said upper end plate.

9. The sequential burner as claimed in claim 7, wherein each of said plurality of fingers is configured as a streamlined body which has a streamlined cross-sectional profile, whereby said streamlined body has two lateral surfaces parallel to a flow direction of hot gas passing through said burner body, whereby said lateral surfaces are joined at their upstream side by a leading edge and at their downstream side forming a trailing edge, and whereby a plurality of nozzles for injecting a gaseous and/or liquid fuel mixed with air is distributed along said trailing edge.

* * * * *